United States Patent [19]

Dandrea

[11] 4,007,859

[45] Feb. 15, 1977

[54] AUXILIARY HOPPER APPARATUS FOR RELOADING PRESS

[76] Inventor: Stanley A. Dandrea, 3735 W. Townley, Phoenix, Ariz. 85021

[22] Filed: Dec. 24, 1975

[21] Appl. No.: 644,192

[52] U.S. Cl. ..... 222/443; 222/451

[51] Int. Cl.[2] ..... G01F 11/28

[58] Field of Search ..... 222/519, 520, 521, 554, 222/443, 451, 452, 453

[56] References Cited

UNITED STATES PATENTS 110,625 1/1871 Booton ..... 222/520 X

*Primary Examiner*—Stanley H. Tollberg
*Assistant Examiner*—Hadd Lane
*Attorney, Agent, or Firm*—Drummond, Nelson & Ptak

[57] ABSTRACT

A reserve supply of shot or powder is held in an elevated receptacle and is delivered through a gravity feed conduit to a valve at the primary hopper of a reloading press. The valve includes a spool for operatively and selectively replenishing the primary hopper, draining the contents of the receptacle, or discontinuing flow from the conduit.

2 Claims, 5 Drawing Figures

AUXILIARY HOPPER APPARATUS FOR RELOADING PRESS

This invention relates to ammunition for firearms and the reloading thereof.

More particularly, the invention relates to reloading equipment and supplies.

In a further aspect, the instant invention concerns apparatus for holding a reserve supply of shot or powder and for delivering same to the reloading press.

It is common practice for the gun enthusiast whether target shooter or hunter, to reload his own ammunition. In addition to the avocational enjoyment, the reloader enjoys certain financial advantages over commercially purchased ammunition and can tailor his ammunition for the intended specific use or firearm.

There are available to the hobbyist semi-automatic or production-type reloading presses which are capable of producing hundreds of rounds of ammunition per hour. Many enthusiasts, particularly shotgun shooters, will reload several hundred or even a few thousand rounds during one session. This is not a disproportionate amount of ammunition when considering that trap and skeet shooters may shoot hundreds of rounds on a given weekend and that hunters may desire to load enough ammunition for an entire season of one type of game or perhaps a few hundred rounds each of differing loads for various game.

Most reloading presses, however, have an inherent limitation. Powder is generally sold in one pound containers while shot is usually packaged in 25 pound bags. Depending upon the particular load being assembled, a pound of powder will charge two hundred or more shells while a 25 pound bag of shot is generally adequate for about 350 loads. In some instances the primary hoppers of a reloading press will hold perhaps a half pound of powder and a few pounds of shot. The reloading enthusiast must, therefore, frequently interrupt the routine of loading ammunition to replenish the hoppers.

Many manufacturers in order to provide greater shot and powder capacity have either provided larger primary hoppers or provided auxiliary hoppers which continuously replenish the primary hoppers. Neither has proven to be an entirely satisfactory solution. Since it is preferable to store powder in an air-tight container the hopper must be drained at the end of the reloading session. However, drain facilities have not generally been provided. Similarly, it is not desirable to store a press with a substantial amount of shot in the hopper as this substantially increases the weight which must be lifted by the hobbyist and also makes the press top heavy and more susceptible to tipping over. The lack of expedient drain facilities is a further handicap when changing from one powder type to another or one shot size to another. It is also noted that the size of a hopper supported by a press is limited, particularly in the matter of shot, by the amount of weight which can be borne by the press without causing possible binding of moving parts.

Accordingly, it is a primary object of the present invention to provide an improved auxiliary hopper apparatus for use in combination with a reloading press.

Another object of the present invention is the provision of an auxiliary hopper apparatus having extended storage capability.

Yet another object of the present invention is to provide an auxiliary hopper apparatus which will handle either shot or powder.

Still another object of the invention is to provide an auxiliary hopper apparatus which will continuously replenish the primary hopper of a reloading press.

And another object of the invention is the provision of a hopper apparatus in which the material flow therefrom is readily started or discontinued at the option of the user.

A further object of the instant invention is the provision of a hopper apparatus which can be fabricated in an appropriate size to hold a plentiful supply of reloading component the weight of which is not borne by the reloading press.

And a further object of the instant invention is the provision of a hopper apparatus which can be readily and conveniently drained.

And still a further object of the instant invention is the provision of an auxiliary hopper apparatus of the above type which can be used for storage of reloading components when not in use.

Briefly, to achieve the desired objectives of the present invention in accordance with a preferred embodiment thereof, first provided is a receptacle for holding a quantity of granular material, such as shot or powder, which is supported in an elevated position by means independent of the reloading press. A delivery conduit receives material from a gravity flow discharge port proximate the bottom of the receptacle and conducts the material to valve means located at the other end of the conduit. The valve means includes a movable spool for selectively discharging the material through first and second ports. One of the discharge ports is arranged to feed the primary hopper while the other port provides a drain for emptying the contents of the receptacle.

The foregoing and further and more specific objects and advantages of the present invention will become readily apparent to those skilled in the art from the following detailed description of a preferred embodiment thereof taken in conjunction with the drawings in which.

Figure 3:
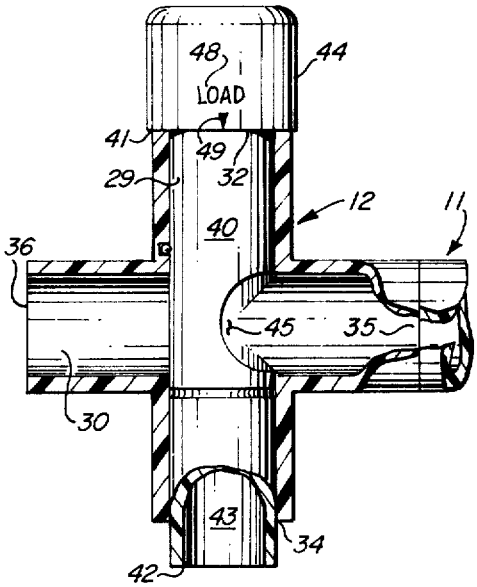
FIG. 3 is a frontal elevational view of the valve means of FIG. 2 and having a portion of the outer housing thereof broken away for purposes of illustrating the arrangement of elements thereof when the valve is set for replenishing the supply of reloading component to the primary hopper of a reloading press.
Figure 4:
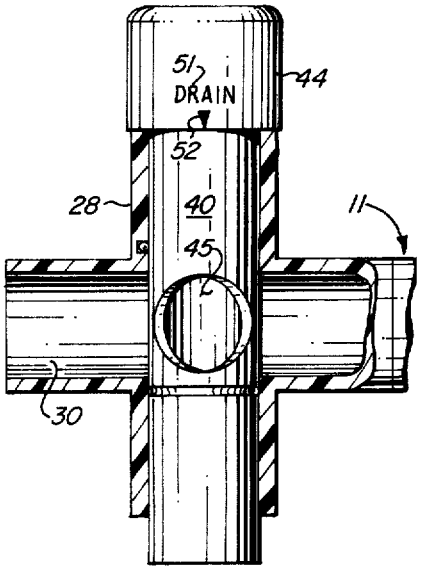
Figure 5:
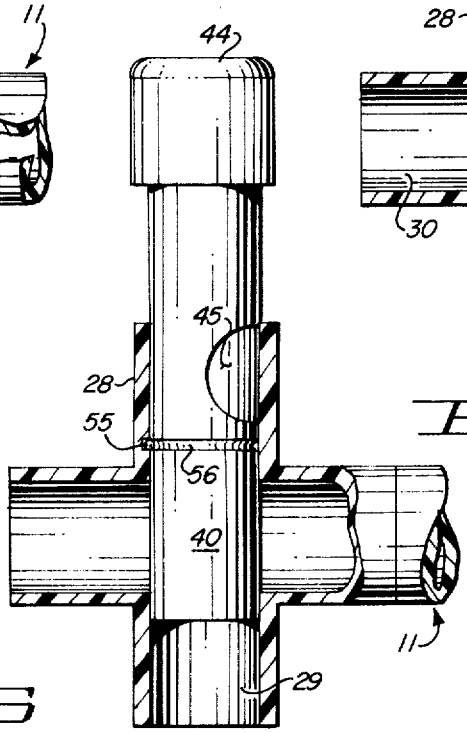

FIG. 4 is a frontal elevational view partly broken and corresponding to the view of the valve of FIG. 3 except illustrating the valve as it would appear when set for draining the receptacle; and FIG. 5 is a frontal elevational view partly broken and corresponding to the view of the valve of FIG. 3 and illustrating the arrangement of components thereof when in the shut position to discontinue flow from the receptacle.

Figure 1:
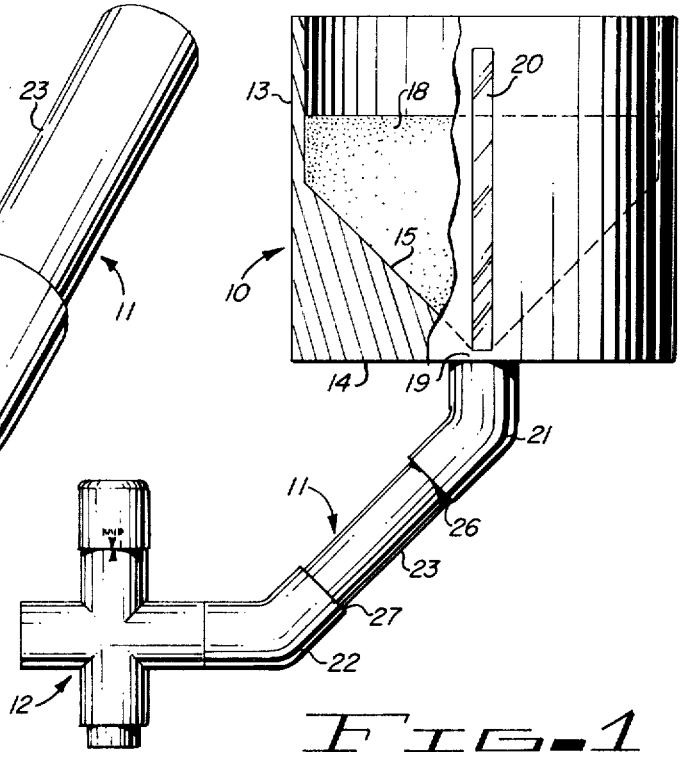
FIG. 1 is a frontal elevational view, partly in section, of an auxiliary hopper apparatus conducted in accordance with the teachings of the present invention.

Turning now to the drawings in which the same reference numerals indicate corresponding elements throughout the several views, attention is first directed to FIG. 1 which shows the auxiliary hopper apparatus of the instant invention having a receptacle, a delivery conduit, and a valve means generally designated by the reference characters 10, 11 and 12, respectively. Container 10 includes cylindrical sidewall 13 and bottom 14 having inverted conical surface 15.

Carried within receptacle 10 is a quantity of granular ammunition reloading material 18. Granular ammunition reloading material as used herein refers to shot or powder either of which is a solid fluid. Inverted conical surface 15 directs granular material 18 to discharge port 19 passes under force of gravity. A section of the solid receptacle 10 is removed and replaced by transparent insert 20 for sight detection of the level of material 18 within receptacle 10. Although not specifically herein illustrated it will be appreciated that receptacle 10 may be supported in any conventional manner such as a bracket which is attached to a wall or upright panel or by a support stand resting upon the table or bench which also supports the reloading press.

In accordance with the illustrated embodiment of the invention delivery conduit 11 has a first elbow 21 secured to receptacle 10 and positioned for receiving material from discharge port 19, a second elbow 22 secured to valve means 12 and tubular member 23 therebetween. Lower end 26 of first elbow 21 and upper end 27 of second elbow 22 are provided with female sockets for receiving the respective ends of tubular member 23 in frictional engagement. In this manner tubular member 23 can be provided by the manufacturer in an extended length and subsequently cut to the desired length by the user. Obviously the desired length of tubular member 23 will be determined by the distance from the selected mounting location of receptacle 10 to the location wherein it is required to have valve means 12.

Although not specifically herein illustrated, first elbow 21 may be secured to receptacle 10 by means of a swivel connection the specific structure of which will be readily apparent to those skilled in manufacturing techniques. The swivel connection is particularly desirable when receptacle 10 is permanently mounted especially upon a wall adjacent the reloading work bench. During periods of disuse, when the reloading press is stored away, delivery conduit 11 and valve means 12 are swivelled rearward against the wall so as not to be in the way of other activities of the hobbyist. For other reasons of accommodation delivery conduit 11 may include a flexible member or alternately provided with a telescopic extension arrangement.

Figure 2:
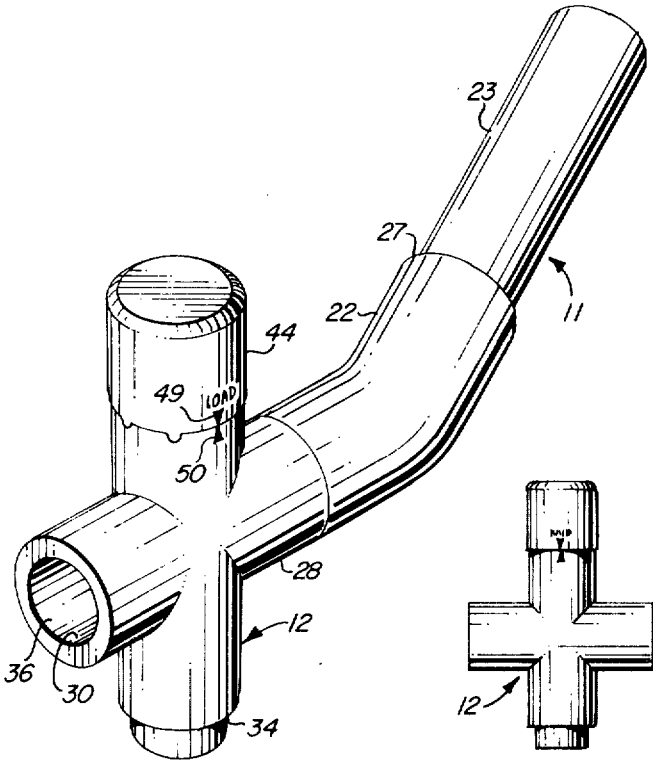
FIG. 2 is an enlarged perspective view of the valve means associated with the hopper apparatus of FIG. 1.

Valve means 12 as is further seen in FIGS. 2 and 3 includes a body 28 having first and second intersecting elongate bores 29 and 30, respectively. First bore 29 terminates with an upper end 33 and a lower end 34 while second elongate bore 30 has an inlet end 35 and a discharge end 36.

Spool 40 having upper and lower ends 41 and 42 and longitudinal bore 43 is rotatably and slidably carried within first bore 29. Lower end 42 is open to bore 43 while upper end 41 is closed by operating knob 44 which having a larger diameter than bore 29 rests upon upper end 33 and prevents spool 40 from falling through bore 29. Aperture 45 extends radially through the sidewall of spool 40 from bore 43.

As particularly seen in FIG. 3, aperture 45 is aligned with second bore 30 and directed toward inlet end 35. Granular material 18 fed through delivery conduit 11 enters valve 12 through inlet port 35, passes through aperture 45 and is discharged from lower end 42 into the primary hopper of the reloading press. This is considered the load position as designated by the word load 48 and is arrived at by the operator by aligning indicator mark 49 on operating knob 44 with reference mark 50 on valve body 28.

In FIG. 4 it is seen that spool 40 has been rotated 90° and communication was established between inlet end 35 and outlet end 36 through the notch created in spool 40 by aperture 45. The notch created in spool 40 by aperture 45 is particularly apparent in FIG. 3 wherein aperture 45 is viewed from the side. This is the drain position so indicated by lettering 51 and the alignment of indicator mark 52 with reference mark 50. In the immediate embodiment the granular material 18 is also discharged downwardly filling the primary hopper concurrent with the draining operation.

Sliding spool 40 within bore 29 to the elevated position illustrated in FIG. 5 places aperture 45 at a position remote from communication with second bore 30. Material 18 entering through inlet end 35 abuts the sidewall of spool 40 and flow is discontinued. This is the closed position of valve means 12. Valve means 12 is retained in the closed position by the engagement of spring and ball detent 55 engaging circumferential groove 56 carried by spool 40.

Various changes and modifications to the device herein chosen for purposes of illustration will readily occur to those skilled in the art. For example, minor modification of spool 40 can be had by terminating bore 43 below bore 30 and replacing aperture 45 to communicate with bore 43. Concurrent therewith a transverse bore is passed through spool 40 at the present location of aperture 45. As a result, the placement of spool 40 as seen in FIG. 3 will facilitate draining receptacle 10 while bypassing the primary hopper. The load position is now reached when spool 40 is elevated as seen in FIG. 5. From either position rotation of spool 40 through 90° will provide a shut-off.

Receptacle 10 has been herein described as being cylindrical simply as a matter of manufacturing expediency. It will be appreciated that other shapes are functionally equivalent. Further, receptacle 10 can be provided with a lid or closure member to prevent contamination of material contained therein. A preferred material for the device of the instant invention is polyvinylchloride which is sufficiently strong for the intended purpose and readily fabricated through injection molding. Other plastic and metallic materials will readily occur to those skilled in the art.

Having fully described and disclosed the foregoing invention and the preferred embodiment thereof in such clear and concise terms as to enable those skilled in the art to understand and practice the same, the invention claimed is:

1. An auxiliary hopper apparatus for holding a reserve quantity of granular ammunition reloading material and for selectively providing a continuous supply of said material to the primary hopper of the reloading press, said auxiliary hopper apparatus comprising:

a. a receptacle for holding a quantity of said granular material and having a gravity flow discharge port proximate the bottom thereof;

b. a delivery conduit having opposite inlet and outlet ends, said inlet end communicating with said discharge port and said conduit extending downwardly therefrom to said outlet end; and c. valve means associated with said delivery conduit at said outlet end, said valve means including:

i. a body having a first elongate bore therethrough and a second elongate bore having inlet and outlet ends and extending therethrough and intersecting said first bore, ii. a spool rotatably and slidably carried within said first bore having a body member with a longitudinal bore extending therethrough having an open end and a closed end, and said body member defining an aperture extending radially from said longitudinal bore through said member, iii. said spool being selectively movable to a first open position wherein said aperture is aligned with said second bore and directed toward said inlet end thereof for providing communication between said inlet of said second bore and said open end of said spool; a second open position rotatable from said first position wherein said aperture is aligned such that said inlet end of said second bore communicates with said outlet end of said second bore and a closed position placing said aperture at a location remote from said second bore thereby selectively and operatively controlling the flow of granular material.

2. The auxiliary hopper apparatus of claim 1, further including detent means for retaining said spool in said closed position.

* * * * *